US007534126B2

(12) United States Patent
Ozawa et al.

(10) Patent No.: US 7,534,126 B2
(45) Date of Patent: May 19, 2009

(54) ELECTRICAL CONNECTION BOX

(75) Inventors: Keisuke Ozawa, Kakegawa (JP); Tomohiro Sugiura, Kakegawa (JP); Katsuhiro Kubota, Kakegawa (JP); Katsuyoshi Kobayashi, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/970,869

(22) Filed: Jan. 8, 2008

(65) Prior Publication Data

US 2008/0164793 A1 Jul. 10, 2008

(30) Foreign Application Priority Data

Jan. 10, 2007 (JP) ..... 2007-002380

(51) Int. Cl.
*H01R 13/627* (2006.01)

(52) U.S. Cl. ..... 439/353

(58) Field of Classification Search ..... 439/326, 439/341, 376, 353, 357
See application file for complete search history.

(56) References Cited

U.S. PATENT DOCUMENTS 3,617,985 A * 11/1971 Kehl ..... 439/341
3,883,856 A * 5/1975 Saito et al. ..... 365/52
6,743,035 B1 * 6/2004 Yang ..... 439/326
7,303,420 B2 * 12/2007 Huch et al. ..... 439/341

FOREIGN PATENT DOCUMENTS

| | | | |
|---|---|---|---|
| JP | 09-163552 | A | 6/1997 |
| JP | 2000-316219 | A | 11/2000 |
| JP | 2001-078329 | A | 3/2001 |
| JP | 2005-176539 | A | 6/2005 |
| JP | 2006-187052 | A | 7/2006 |

* cited by examiner

*Primary Examiner*—Phuong K Dinh
(74) *Attorney, Agent, or Firm*—Sughrue Mion, PLLC

(57) ABSTRACT

An electrical connection box includes a body, a mounting member attached to the body, a lock arm which is provided at one of the body and the mounting member, and a lock receiving portion which is provided at the other of the body and the mounting member. The lock arm includes an arm portion and a first engaging portion. The lock receiving portion includes a receiving portion which has an inserting portion and a second engaging portion. The receiving portion includes a projection which projects from the surface of the receiving portion farther than the second engaging portion from the inserting portion so as to abut on the arm portion to locate the lock arm in a predetermined position. When the first engaging portion engages with the second engaging portion, a clearance is formed between the receiving portion and the arm portion.

9 Claims, 9 Drawing Sheets

ELECTRICAL CONNECTION BOX

BACKGROUND

This invention relates to an electrical connection box to be mounted on a vehicle or the like, and more particularly to an electrical connection box in which a body and a mounting member to be mounted on the body are releasably connected together through a hinge.

An electrical connection box (also called a junction block) includes a body including a housing having a plurality of electronic parts (such for example as fuses, relays, etc.) received therein, and an electronic control unit (ECU) (serving as a mounting member) having a control circuit for controlling the plurality of electronic parts.

Generally, the above electrical connection box is constructed such that the electronic control unit is incorporated in the housing of the body (see, for example, Patent Literature 1). In recent years, however, in order to enhance the efficiency of maintenance in the event of a malfunction of the control circuit or the electronic control unit and also to reduce the cost required for exchanging parts, there have been used electrical connection boxes of the type in which an electronic control unit having a control circuit received in a housing separate from a housing of a body is fixedly attached to the body by fixing means such as a lock, a hinge, screws or others (see, for example, Patent Literature 2).

In the electrical connection box disclosed in Patent Literature 2, the electronic control unit and the body are fixed to each other by a hinge and locks so that the former can be easily attached to the body with less time and labor. This hinge includes a hook formed at one end of the electronic control unit, and a hook receiving recess which is formed at one end of the body such that the hook can be rotatably and releasably received in this hook receiving recess. The lock includes a lock arm formed at the other end of the electronic control unit, and a lock arm insertion hole which is formed in the other end of the body such that the lock arm can be engaged in this lock arm insertion hole. In this electrical connection box, the hook is engaged in the hook receiving recess, and then the electronic control unit is rotatably moved toward the body about the hook, so that the lock arm is engaged in the lock arm insertion hole, thereby fixing the electronic control unit to the body.

[Patent Literature 1] JP-A-2006-187052

[Patent Literature 2] JP-A-9-163552

In the electrical connection box disclosed in the above Patent Literature 2, a clearance is formed between the electronic control unit and the body for the purpose of enhancing the efficiency of the operation for mounting the electronic control unit on the body and also for reasons of design. However, there has been encountered a problem that this clearance is a factor in the development of a relative shaking movement between the electronic control unit and the body after the electric control unit is attached to the body.

The above problem of the shaking movement can be dealt with, for example, by fixing the electronic control unit and the body together by screws after the former is attached to the latter. In this case, however, there arises another problem that the number of component parts increases, and besides the operation for mounting the electronic control unit on the body becomes cumbersome.

SUMMARY

It is therefore an object of this invention to provide an electrical connection box in which a mounting member can be easily attached to a body, and also a relative shaking movement between the mounting member and the body can be prevented from developing after the former is attached to the latter.

The above object has been achieved by an electrical connection box of the invention which includes a body;

a mounting member attached to the body;

a lock arm which is provided at one of the body and the mounting member, the lock arm including:

an arm portion; and a first engaging portion provided at the arm portion;

a lock receiving portion which is provided at the other of the body and the mounting member, the lock receiving portion including:

- a receiving portion which has an inserting portion to receive the arm portion; and
- a second engaging portion provided at a surface of the receiving portion so as to be engaged with the first engaging portion, wherein the arm portion extends generally in an inserting direction in which the arm portion enters into the receiving portion;

wherein the receiving portion includes a projection which projects from the surface of the receiving portion farther than the second engaging portion from the inserting portion so as to abut on the arm portion to locate the lock arm in a predetermined position; and wherein when the first engaging portion engages with the second engaging portion, a clearance is formed between the receiving portion and the arm portion.

Preferably, one of the first engaging portion and the second engaging portion has a through hole, and the other of the first engaging portion and the second engaging portion has a convex shape.

Preferably, one of the first engaging portion and the second engaging portion has a concave shape, and the other of the first engaging portion and the second engaging portion has a convex shape.

Preferably, a plurality of the projections are provided so as to hold the arm portion therebetween.

Preferably, a plurality of the projections are provided in such a manner that the projections are spaced to each other along the surface of the receiving portion.

Preferably, a clearance is formed between an outer wall providing the lock arm and an outer wall providing the lock receiving portion.

Preferably, the body and the mounting member are rotatably connected together at their one ends through a hinge, and the lock arm and the lock receiving portion are provided at the other ends of the body and the mounting member.

Preferably, the body includes a first board having a first connector, and the mounting member includes a second board having a second connector and when the mounting member is attached to the body, the first connector is fitted to the second connector so that the first board is electrically connected to the second board.

In the above configuration, the engaging portion is formed on that portion of the inner surface of the receiving portion disposed deeper than the lock projection in the direction of inserting of the arm portion into the receiving portion, and abuts against the arm portion to locate the lock arm in the predetermined position thereof, thereby locating the mounting member in the predetermined position thereof relative to the body. Therefore, even when a clearance is formed between the mounting member and the body, the mounting member can be located in the predetermined position relative to the body merely by engaging the lock arm with the lock receiving portion without fixing the mounting member and the body to each other by screws or the like. Therefore, there can be provided the electrical connection box in which the mounting member can be easily attached to the body, and also a relative shaking movement between the mounting member and the body can be prevented from developing after the mounting member is attached to the body.

In the above configuration, the engaging portion shaped in a convex or concave, or having a through hole is formed on that portion of the inner surface of the tubular portion disposed deeper than the projection receiving portion in the direction of inserting of the arm portion into the tubular portion, and abuts against the arm portion to locate the lock arm in the predetermined position thereof, thereby locating the mounting member in the predetermined position thereof relative to the body. Therefore, even when a clearance is formed between the mounting member and the body, the mounting member can be located in the predetermined position relative to the body merely by engaging the lock arm with the lock receiving portion without fixing the mounting member and the body to each other by screws or the like. Therefore, there can be provided the electrical connection box in which the mounting member can be easily attached to the body, and also a relative shaking movement between the mounting member and the body can be prevented from developing after the mounting member is attached to the body.

In the above configuration, the plurality of projecting portions are provided so as to hold the arm portion therebetween. Therefore, the arm portion can be located in a generally central region of the receiving portion in a direction of opposing of the projecting portions to each other, and therefore the arm portion can be positioned with a smaller amount of movement of the arm portion as compared with the case where the arm portion is positioned by causing a projecting portion to abut against only one side (or surface) of the arm portion such that the arm portion abuts against that portion of the inner surface of the receiving portion opposed to this projecting portion. Therefore, the mounting member can be more smoothly attached to the body.

In the above configuration, the projecting portions are formed on and along the inner surface of the receiving portion, and are spaced from each other. Therefore, the area of contact of these projecting portions with the arm portion can be reduced, and a frictional resistance can be reduced, and therefore the arm portion can be located in the predetermined position within the receiving portion with a smaller force. And besides, a lightweight design of the electrical connection box can be achieved.

In the above configuration, the clearance is formed between the outer wall having the lock arm formed thereon and the outer wall having the lock receiving portion formed thereon. Therefore, the mounting member can be smoothly attached to the body without being caught thereon, and therefore the mounting member can be more easily attached to the body In the above configuration, the body and the mounting member are pivotally connected together at their one ends through the hinge, and the fixing portion is provided at the other ends of the body and the mounting member. Therefore, the mounting member can be quite easily attached to the body without effecting a precise positioning. Furthermore, the mounting member, while pivotally moved about the hinge, is attached to the body, and with this construction a larger clearance must be formed between the mounting member and the body as compared with the case where the mounting member is moved linearly toward the body, and is attached thereto. In the invention, however, even when such large clearance is provided, a relative shaking movement can be prevented from developing between the mounting member and the body, and therefore there can be provided the electrical connection box in which the mounting member can be easily attached to the body, and also a relative shaking movement between the mounting member and the body can be prevented from developing after the mounting member is attached to the body.

In the above configuration, the board having the connector mounted thereof is mounted within the body and the board having the connector mounted thereon is mounted within the mounting member, and when the mounting member is attached to the body, the connectors are fitted to each other, so that the boards are electrically connected together. In this electrical connection box, a relative shaking movement between the mounting member and the body can be prevented, and therefore wear of terminals of the connectors can be prevented, and also the reliability of connection between the terminals and hence the reliability of connection between the boards can be secured.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF PREFERRED EMBODIMENTS

Figure 1:
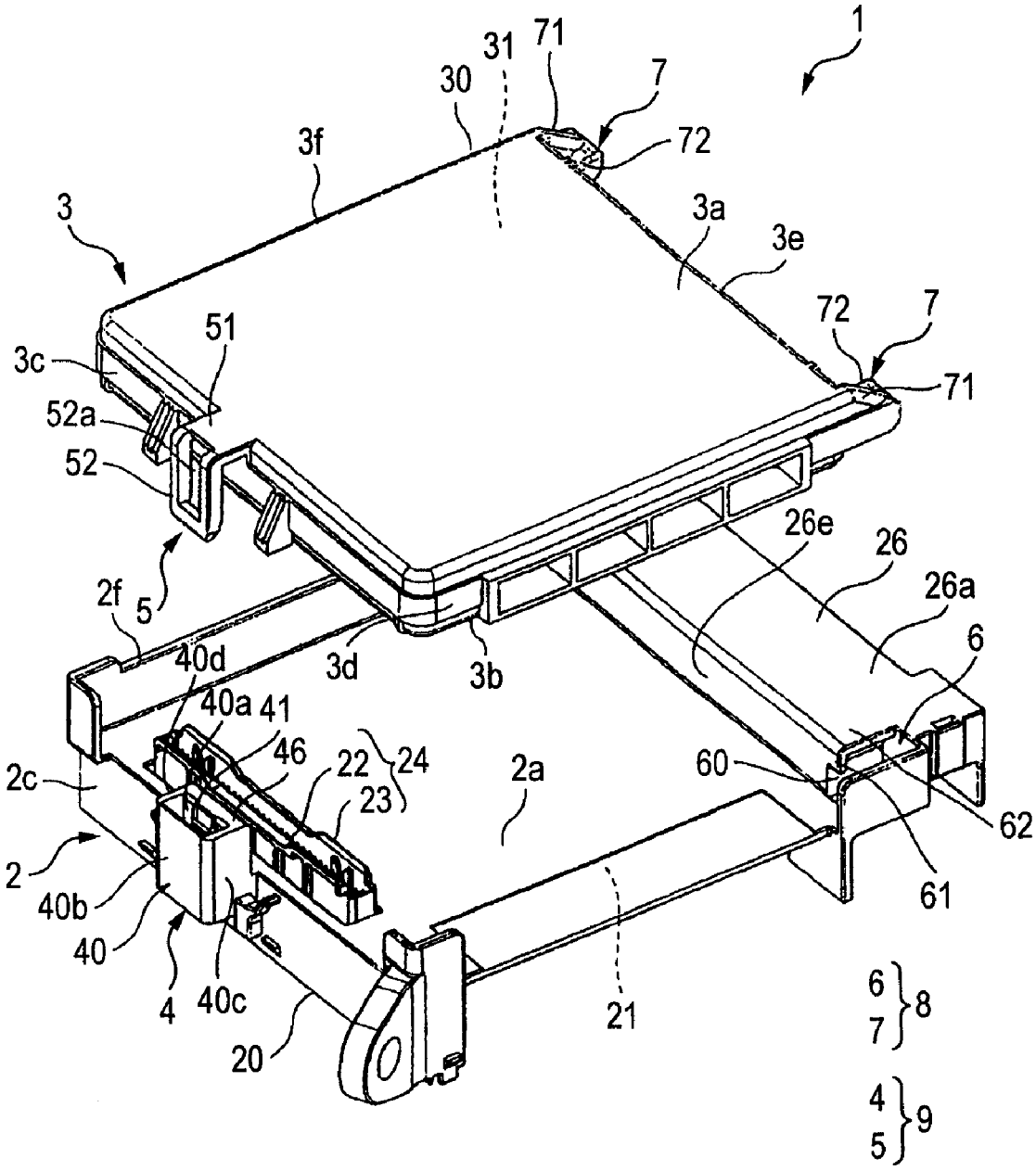
FIG. 1 is a perspective view of one preferred embodiment of an electrical connection box of the present invention, showing a condition in which a body and a mounting member are separated from each other.

One preferred embodiment of an electrical connection box of the present invention will now be described with reference to FIGS. 1 to 9. The electrical connection box 1 of this embodiment is fixed to a panel forming a vehicle body of an automobile or other portion of the automobile, and various electronic equipments mounted on the automobile are electrically connected together in a predetermined pattern through this electrical connection box 1.

As shown in FIGS. 1 to 4, the electrical connection box 1 includes a body 2, and an electronic control unit (hereinafter referred to as "ECU" which is an abbreviation of Engine Control Unit) 3 serving as a mounting member to be attached to the body 2, hinges 8 rotatably and releasably connecting the body 2 and the ECU 3 together, a fixing portion 9 for fixing the body 2 and the ECU 3 to each other.

The body 2 includes a housing 20 made of an insulative synthetic resin, and a printed circuit board 21 (see FIGS. 6 to 8) mounted on the housing 20.

The housing 20 includes a mounting surface portion 2*a* in the form of a square plate, a block-like interconnecting portion 26 formed integrally at one end of the mounting surface portion 2*a* (that is, one outer edge of the mounting surface portion 2*a*), an upstanding wall 2*c* formed on and extending downwardly (FIG. 1) from the other end of the mounting surface portion 2*a* (that is, that outer edge of the mounting surface portion 2*a* remote from the interconnecting block 26), an upstanding portion 46 continuous with the upstanding wall 2*c* and extending upwardly (FIG. 1) from the mounting surface portion 2*a*, and a guide wall 2*f* formed on and extending upwardly from that outer edge of the mounting surface portion 2*a* lying between the interconnecting portion 26 and the upstanding wall 2*c*.

The connecting portion 26 includes a surface 26*e* extending in a direction perpendicular to the mounting surface portion 2*a* and intersecting the one end of the mounting surface portion 2*a*, and a surface 26*a* extending from that end of the surface 26*e* disposed above the mounting surface portion 2*a* (in FIG. 1) in a direction parallel to the mounting surface portion 2*a*.

The upstanding portion 46 is in the form of a square plate, and provided in a direction perpendicular to the mounting surface portion 2*a*.

The guide wall 2*f* extends upwardly (in FIG. 1) from the outer edge of the mounting surface portion 2*a*, that is, in a direction perpendicular to the mounting surface portion 2*a*.

Figure 5:
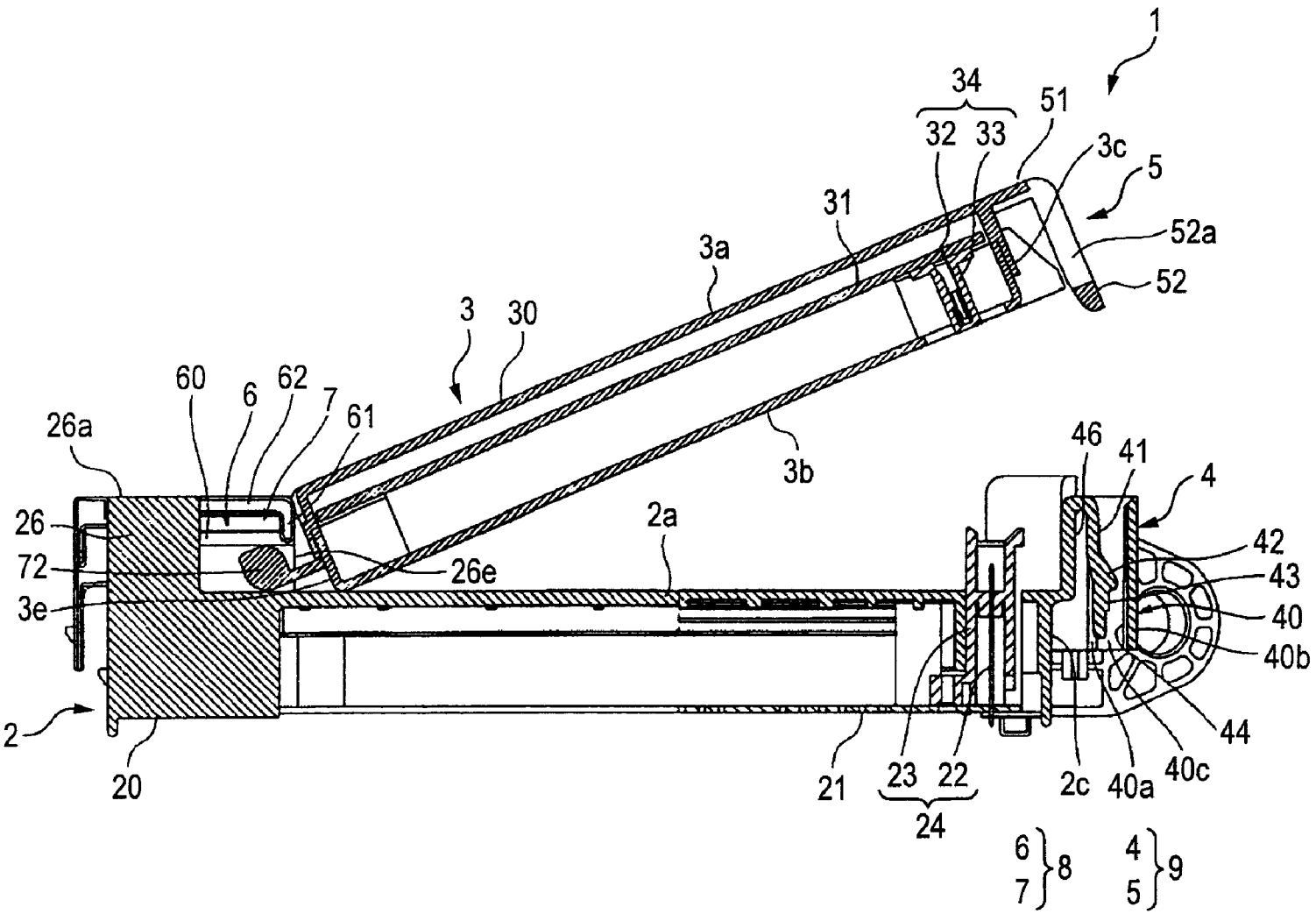
FIG. 5 is a cross-sectional view of the electrical connection box of FIG. 2 taken along the line K-K of FIG. 4.
Figure 6:
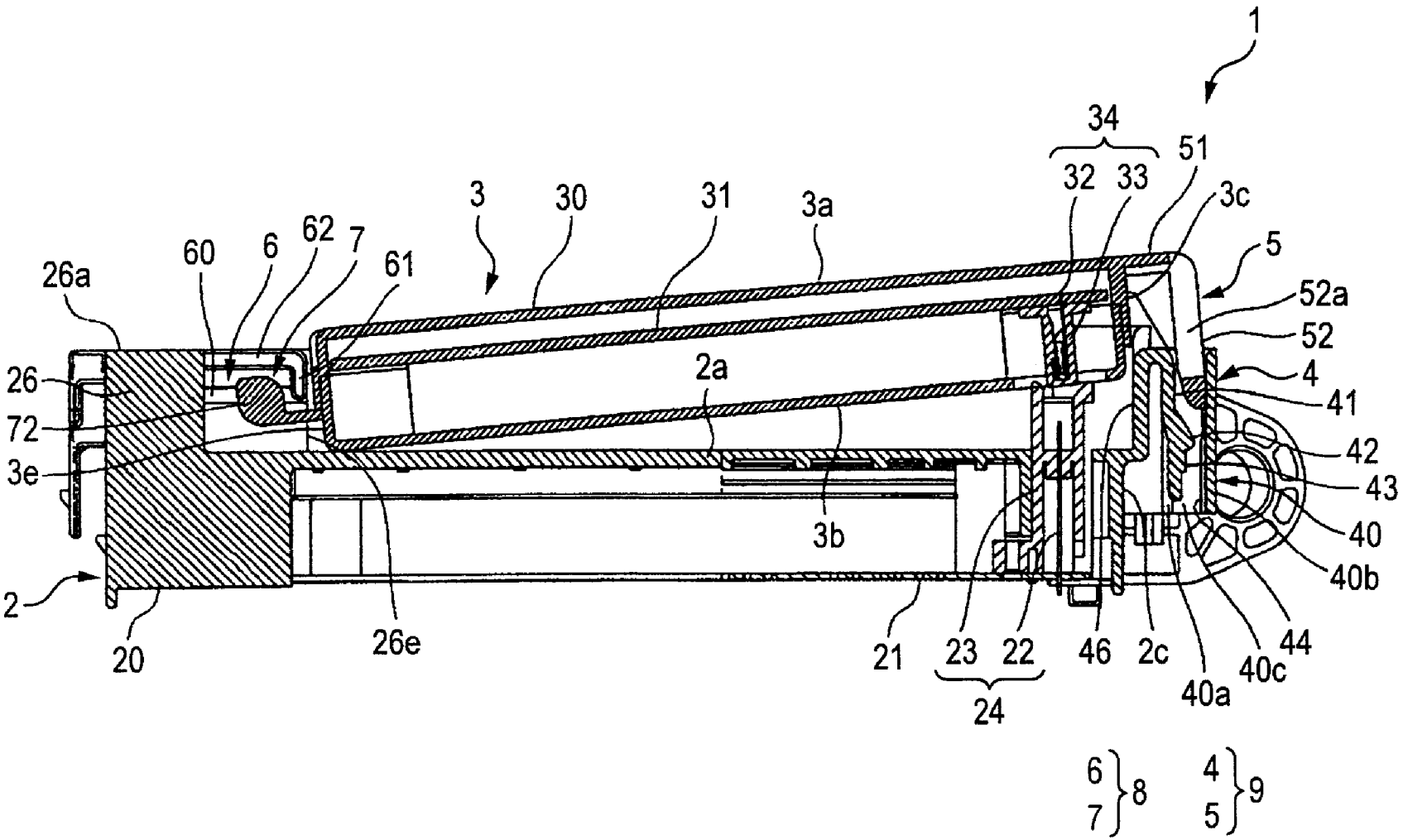
FIG. 6 is a cross-sectional view of the electrical connection box showing a condition in which the mounting member is further moved from its position of FIG. 5 toward the body.
Figure 7:
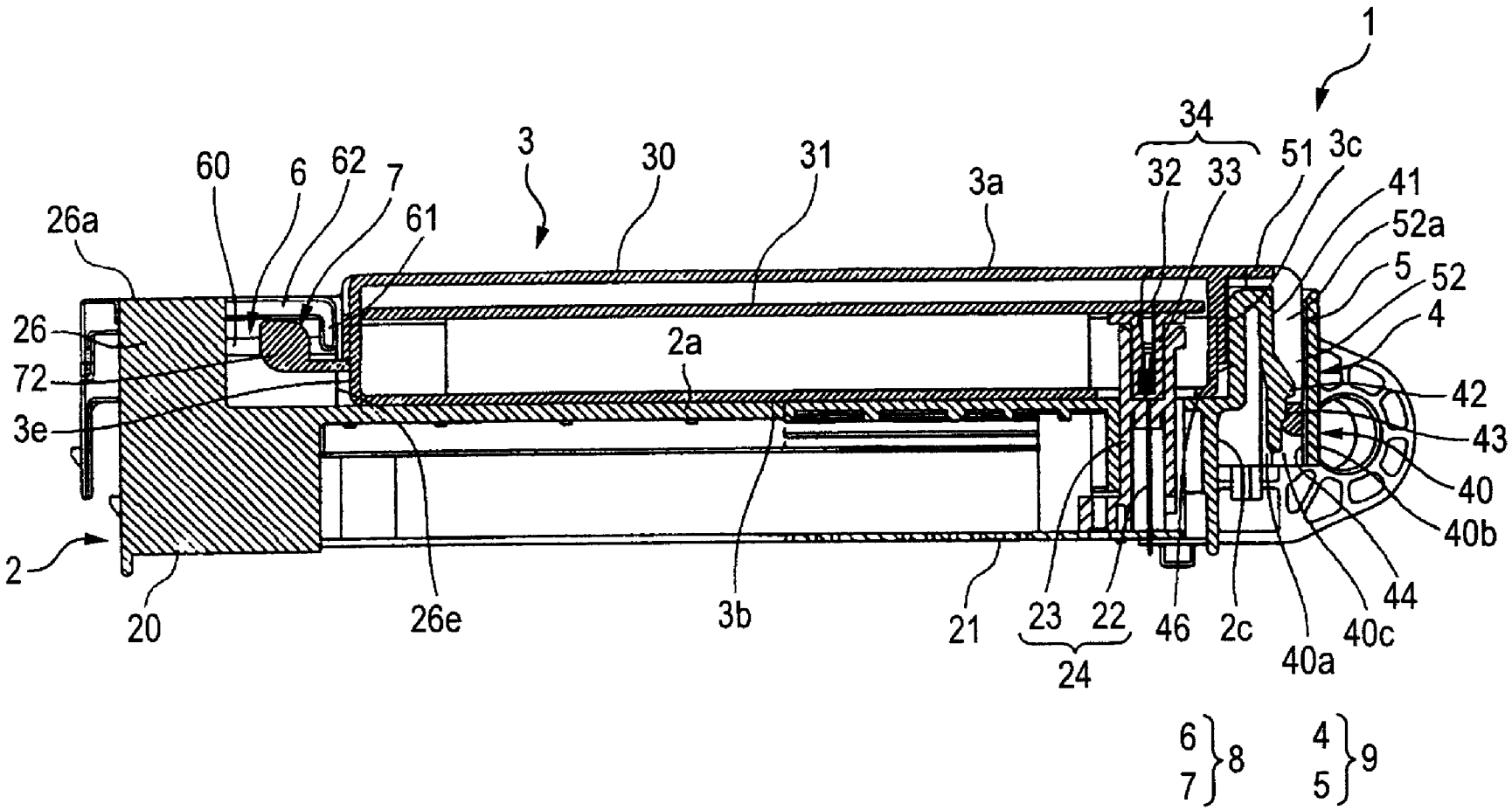
FIG. 7 is a cross-sectional view taken along the line K-K of FIG. 4.

The printed circuit board 21 is a well-known printed circuit board having relays and fuses mounted thereon. As shown in FIGS. 5 to 7, this printed circuit board 21 is disposed under the mounting surface portion 2*a* (in FIG. 6) in parallel to the mounting surface portion 2*a*. The printed circuit board 21 has a connector 24 for electrically connecting this printed circuit board 21 to a printed circuit board 31 (described later) of the ECU 3.

The connector 24 includes bar-like male terminals 22 which are connected to a circuit pattern formed on the printed circuit board 21 and extend upwardly toward the mounting surface portion 2*a*, and a synthetic resin-made connector housing 23 of a tubular shape surrounding the plurality of the male terminals 22. This connector 24 passes through a through hole formed through the mounting surface portion 2*a* such that part of the connector 24 projects upwardly (in FIG. 5) beyond the mounting surface portion 2*a*.

The ECU 3 includes a housing 30 made of an insulative synthetic resin, and the printed circuit board 31 (see FIGS. 5 to 7) received within the housing 30.

The housing 30 includes an upper wall 3*a* in the form of a square plate generally identical in shape to the mounting surface portion 2*a*, side walls 3*c*, 3*d*, 3*e* and 3*f* extending perpendicularly respectively from four side (or outer) edges of the upper wall 3*a*, and a lower wall 3*b* disposed in opposed, spaced relation to the upper wall 3*a* and integrally connected to lower edges of the side walls 3*c*, 3*d*, 3*e* and 3*f* remote from the upper wall 3*a*. Namely, this housing 30 has a flat plate-like outer shape, and has an internal space for receiving the printed circuit board 31 therein.

Figure 3:
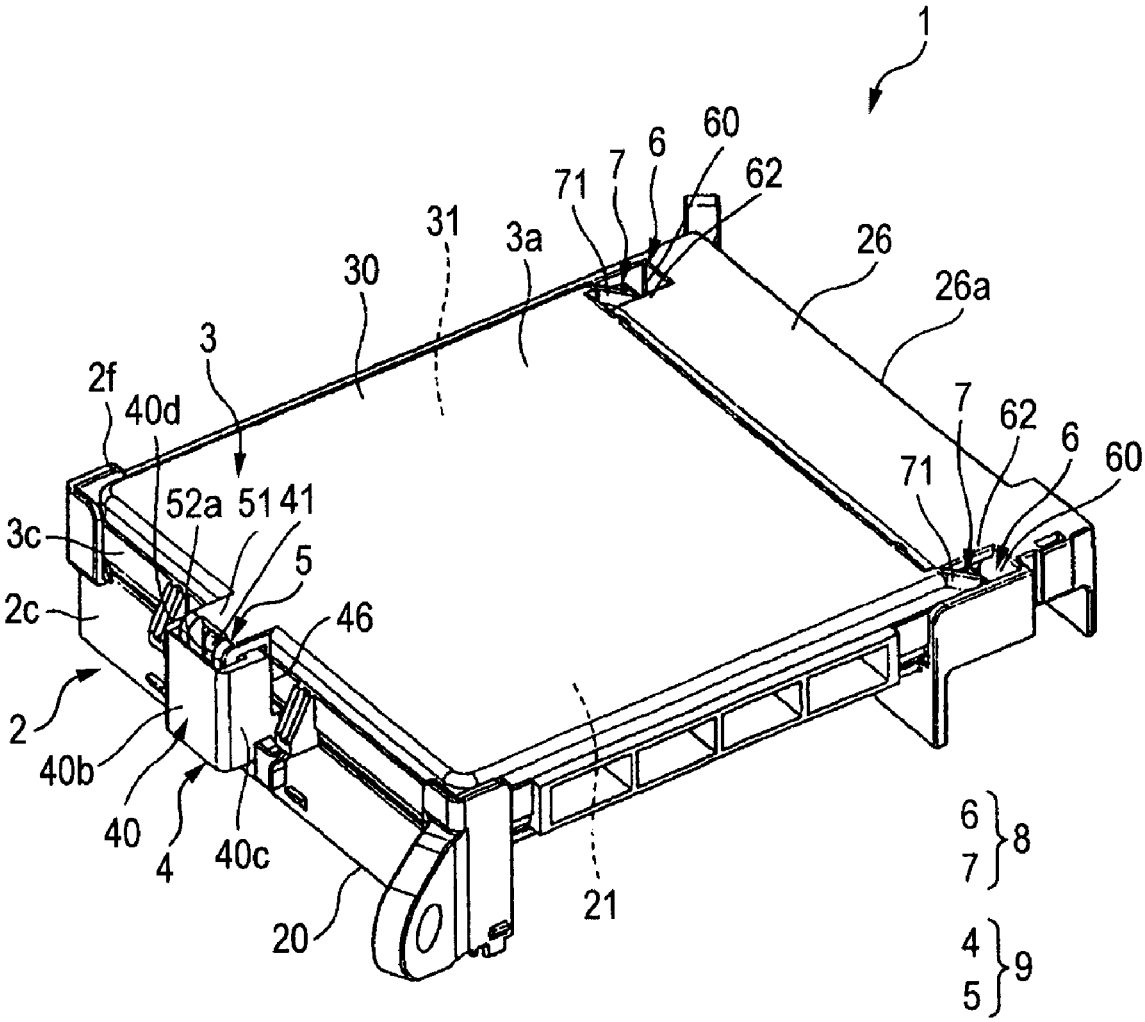
FIG. 3 is a perspective view showing a condition in which the mounting member of FIG. 2 is attached to the body.
Figure 4:
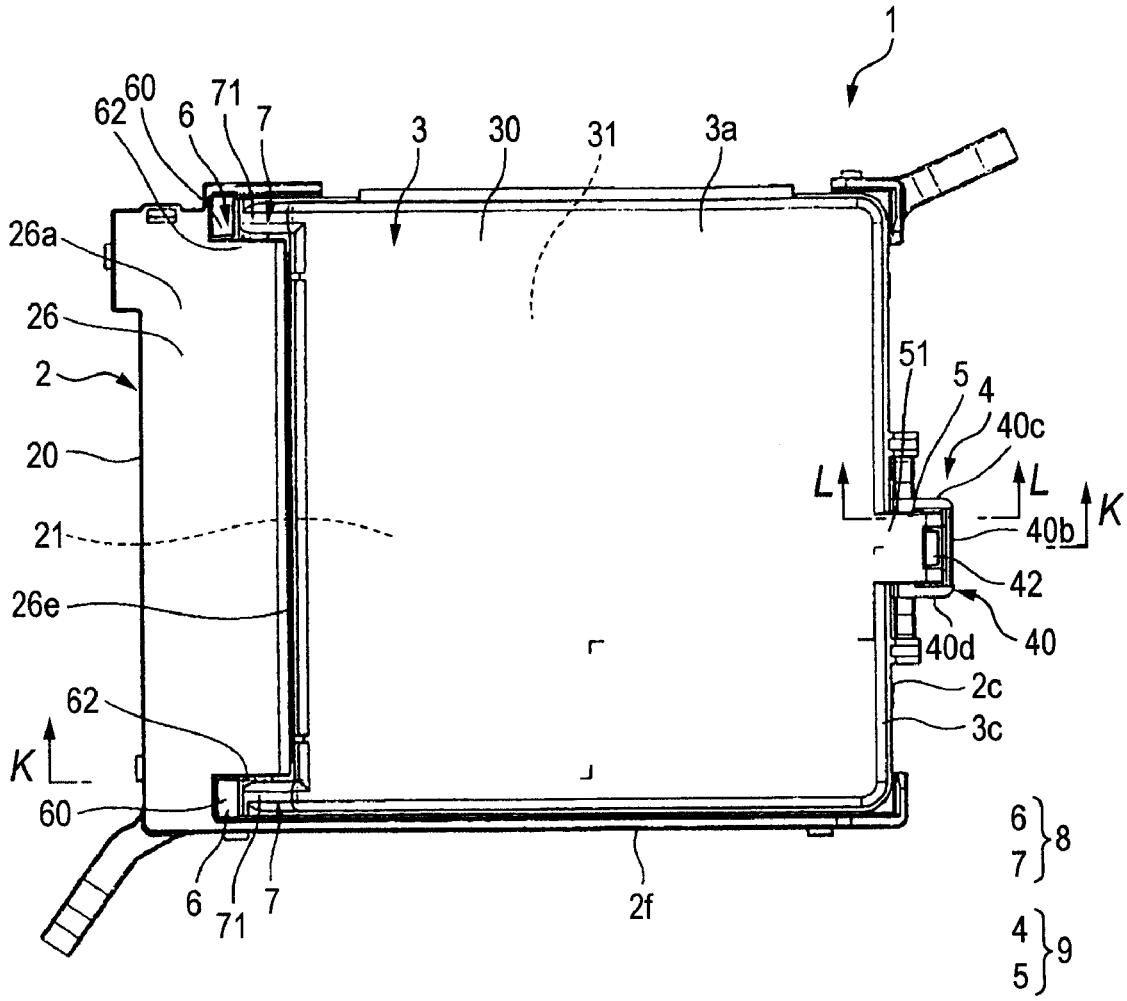
FIG. 4 is a front-elevational view of the electrical connection box of FIG. 3.

The housing 30 is attached to the body 2 in such a manner that the lower wall 3*b* abuts against the mounting surface portion 2*a* and that the side wall 3*f* abuts against the guide wall 2*f* (see FIGS. 3 and 4). Namely, the housing 30 is received in a frame-like space formed by the surface 26*e*, the guide wall 2*f* and the upstanding portion 46. A dimension of the housing 30 from an outer surface of the side wall 3*c* to an outer surface of the side wall 3*e* is slightly smaller than a dimension of the housing 20 from the upstanding portion 46 to the surface 26*e*. Namely, when the ECU 3 is attached to the body 2, a clearance 10 is formed between the upstanding portion 46 and the side wall 3*c* (see FIG. 8), and also a clearance is formed between the surface 26*e* and the side wall 3*e*. Since these clearances are to be formed, the ECU 3 can be smoothly attached onto the body 2 without being caught thereon.

The printed circuit board 31 is a well-known printed circuit board having a control circuit for controlling the relays and fuses mounted on the printed circuit board 21 of the body 2. As shown in FIGS. 5 to 7, the printed circuit board 31 is received within the housing 30 in parallel relation to the upper wall 3*a* and the lower wall 3*b*. The printed circuit board 31 has a connector 34 for electrically connecting this printed circuit board 31 to the printed circuit board 21 of the body 2.

The connector 34 includes tubular female terminals 32 which are connected to a circuit pattern formed on the printed circuit board 31 and extend downwardly toward the lower wall 3*b*, and a synthetic resin-made connector housing 33 of a tubular shape receiving the female terminals 32. A through hole is formed through that portion of the lower wall 3*b* corresponding to the connector 34, and the connector 24 of the body 2 is fitted to the connector 34 through this through hole. In the present specification, the fitting of these connectors means that the male terminals 22 are inserted respectively into the female terminal 32 to be electrically connected thereto.

Each of the hinges 8 includes a rotation portion 7 formed at one end of the ECU 3, and a shaft receiving portion 6 formed at one end of the body 2.

As shown in FIG. 1, the rotation portion 7 includes a shaft leg 71 formed on the side wall 3*e* and extending in a direction away from the side wall 3*c*, and a shaft portion 72 formed at a distal end of the shaft leg 71 (remote from the side wall 3*e*) and extending along a direction of opposing of the side wall 3*f* and the side wall 3*d* to each other. The two rotation portions 7 are provided at the ECU 3, and one of these rotation portions 7 is provided at one longitudinal end of the side wall 3*e* disposed immediately adjacent to the side wall 3*d*, while the other rotation portion 7 is provided at the other longitudinal end of the side wall 3*e* disposed immediately adjacent to the side wall 3*f*. The shaft portions 72 of the pair of rotation portions 7 extend toward each other. Namely, the side wall 3*e* forms one end of the ECU 3 serving as the mounting member, while the side wall 3*c* forms the other end of the ECU 3.

As shown in FIGS. 1 and 5, the shaft receiving portion 6 includes a receiving recess 60 formed at the interconnecting portion 25 and receiving the rotation portion 7 therein, and a first limitation wall 61 and a second limitation wall 62 which prevent the shaft portion 72 from being disengaged from the receiving recess 60 during the rotative movement of the rotation portion 7. The two shaft receiving portions 6 are provided at the interconnecting portion 26 of the body 2, and are spaced from each other, and are disposed respectively at the opposite end portions of the interconnecting portion 26 so as to correspond respectively to the pair of rotation portions 7.

The receiving recess 60 is a cavity extending from the surface 26*e* of the interconnecting portion 26 in a direction away from the upstanding wall 2*c*. This receiving recess 60 is open to both of the surface 26*e* and the surface 26*a*.

The first limitation wall 61 is in the form of a plate, and is disposed in a plane in which the surface 26*e* lies, and this first limitation wall 61 partially closes an opening of the receiving recess 60 open to the surface 26*e*. More specifically, this first limitation wall 61 closes that portion of this opening disposed at the inner side of the body 2 (in FIG. 1) and disposed adjacent to the surface 26*a*. The first limitation wall 61 of this construction prevents the shaft portion 72, located or received in the receiving recess 60, from being disengaged from the receiving recess 60 through the above opening during the rotative movement of the rotation portion 7.

The second limitation wall 62 is in the form of a plate, and is disposed in a plane in which the surface 26*a* lies, and this second limitation wall 62 partially closes an opening of the receiving recess 60 open to the surface 26*a*. More specifically, this second limitation wall 62 closes that portion of this opening disposed at the inner side of the body 2 (in FIG. 1). The second limitation wall 62 of this construction prevents the shaft portion 72, received in the receiving recess 60, from being disengaged from the receiving recess 60 through the above opening during the rotative movement of the rotation portion 7.

The fixing portion 9 includes a lock arm 5 formed on and extending from the side wall 3*c*, and a lock receiving portion 4 formed integrally with the upstanding portion 46 so as to be engaged with the lock arm 5.

Figure 9:
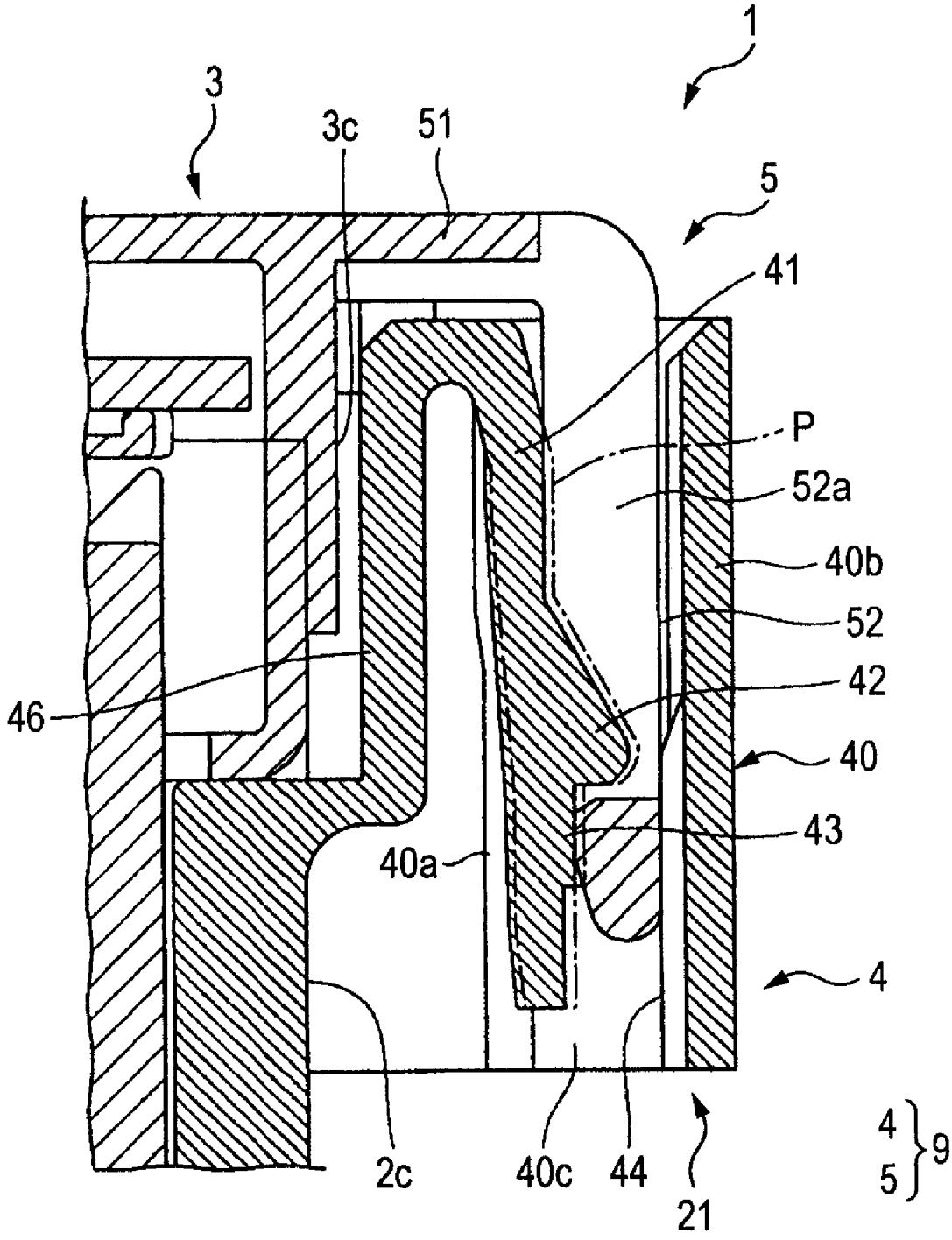
FIG. 9 is an enlarged cross-sectional view taken along the line K-K of FIG. 4, showing an important portion of FIG. 7.

As shown in FIGS. 1 and 9, etc., the lock arm 5 includes an extension portion 51 extending perpendicularly from the side wall 3*c*, an arm portion 52 extending from a distal end of the extension portion 51 (which is remote from the side wall 3*c*) in a direction from the upper wall 3*a* to the lower wall 3*b* (that is, in a direction of superposing of the ECU 3 on the body 2), and a through hole 52*a* formed in the arm portion 52 and serving as a projection receiving portion or an engaging portion.

As shown in FIGS. 1 and 9, etc., the lock receiving portion 4 includes a tubular portion 40 formed integrally with the upstanding portion 46, an elastic piece portion 41, a lock projection 42 serving as an engaging portion, a first projecting portion 43, and second projecting portions 44.

Figure 8:
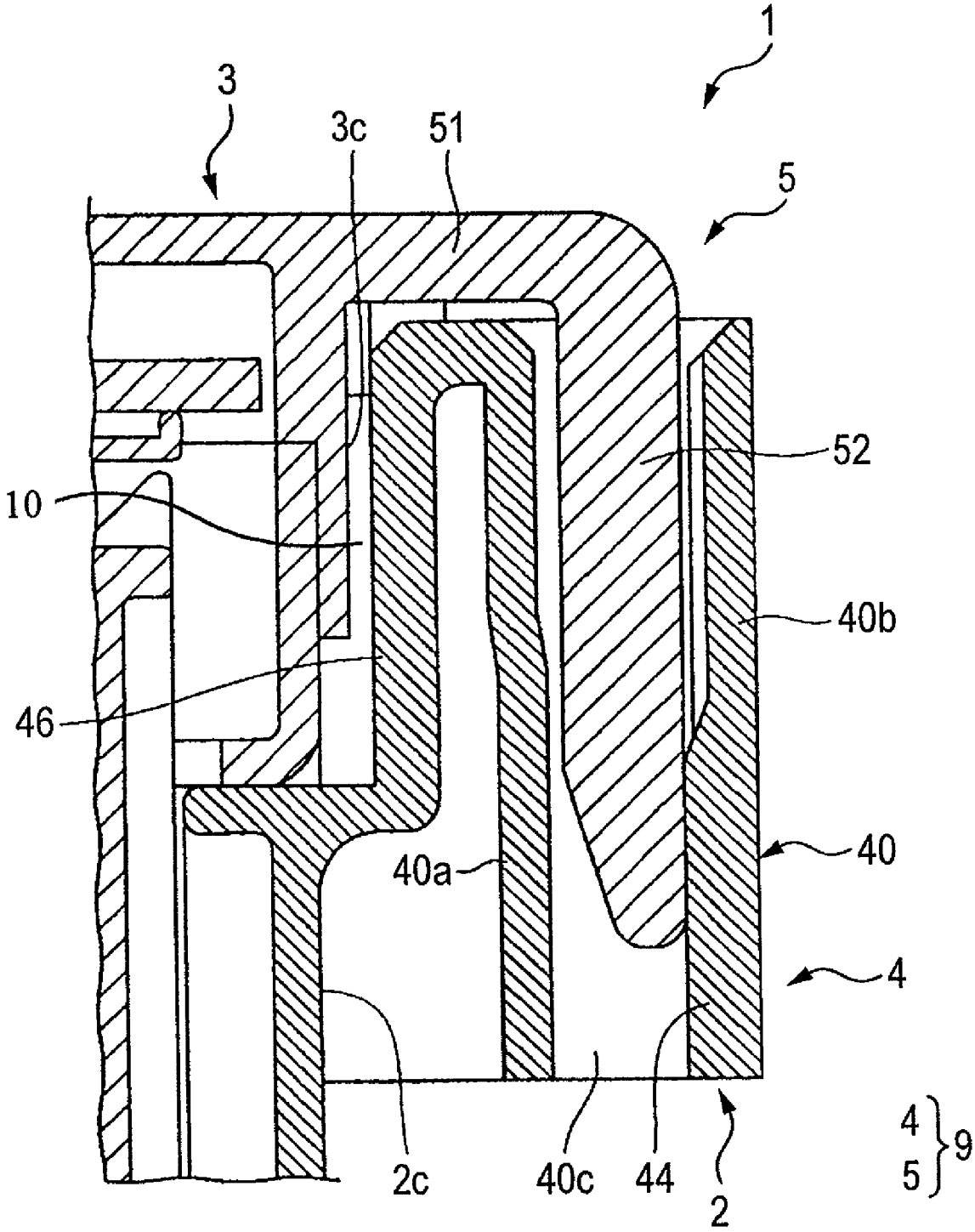
FIG. 8 is an enlarged cross-sectional view taken along the line L-L of FIG. 4, showing an important portion.

The tubular portion 40 is formed into a hollow tubular shape with a generally rectangular cross-section, and this tubular portion 40 includes a first wall 40*a* formed integrally with that end of the upstanding portion 46 remote from the upstanding wall 2*c* and extending downwardly (FIG. 8), a second wall 40*b* spaced from the first wall 40*b* in opposed relation thereto, a third wall 40*c* having opposite side edges integrally connected respectively to the first and second walls 40*a* and 40*b*, and a fourth wall 40*d* having opposite side edges integrally connected respectively to the first and second walls 40*a* and 40*b*. Namely, the upstanding portion 46 and the first wall 40*a* are continuous with each other to assume a generally U-shaped cross-section as shown in FIG. 8. The tubular portion 40 extends parallel to the upstanding wall 2*c* and the upstanding portion 46. Namely, the tubular portion 40 extends in the direction of superposing of the ECU 3 on the body 2. The tubular portion 40 is so shaped and sized that the arm portion 52 can be received in this tubular portion 40 with a clearance formed therebetween as shown in FIG. 8. This clearance is formed according to the difference between the dimension of the housing 20 from the upstanding portion 46 to the surface 26*e* and the dimension of the housing 30 from the outer surface of the side wall 3*c* to the outer surface of the side wall 3*e*.

The elastic piece portion 41 forms part of the first wall 40*a* as shown in FIG. 9. Namely, two slits are formed in the first wall 40*a*, and extend in the direction of superposing of the ECU 3 on the body 2, and that portion of the first wall 40*a* lying between the two slits and assuming a strip-like shape defines the elastic piece portion 41. One longitudinal end of the elastic piece portion 41 is integrally connected to the upstanding portion 46, while the other end (distal end) thereof serves as a free end, and thus the elastic piece portion 41 has a cantilever-like shape. Namely, the elastic piece portion 41 can be deformed in a direction of opposing of the upstanding portion 46 and the second wall 40*b* to each other. This elastic piece portion 41 is inclined toward the second wall 40*b* such that the distance between the two is gradually decreasing toward the distal end of the elastic piece portion 41.

The lock projection 42 is formed on a generally longitudinally-central portion of the elastic piece portion 41, and projects toward the second wall 40*b*. The lock projection 42 has a generally triangular cross-section as shown in FIG. 9. This lock projection 42 is adapted to be engaged in the through hole 52*a* formed in the lock arm 5 when the lock arm 5 is received in the tubular portion 40.

As shown in FIG. 9, the first projecting portion 43 is formed on that portion of the elastic piece portion 41 disposed below the lock projection 42, that is, disposed deeper than the lock projection 42 in a direction of inserting of the arm portion 52 into the tubular portion 40, and projects toward the second wall 40*b*. Here, the expression "the first projecting portion 43 projects" means that the first projecting portion 43 projects more toward the second wall 40*b* than that portion of the elastic piece portion 41 disposed above the lock projection 42.

As shown in FIG. 9, the second projecting portions 44 are formed on that portion of the second wall 40*b* disposed generally below the lock projection 42, that is, disposed deeper than the lock projection 42 in the direction of inserting of the arm portion 52 into the tubular portion 40, and project toward the first wall 40*a*. Here, the expression "the second projecting portions 44 project" means that the second projecting portions 44 project more toward the first wall 40*a* than that portion of the second wall 40*b* disposed above the lock projection 42. There are provided the two second projecting portions 44 spaced from each other in a direction perpendicular to the direction of superposing of the ECU 3 on the body 2.

The first projecting portion 43 and the second projecting portions 44 are so disposed that the arm portion 52 can be located and held between the first projecting portion 43 and the second projecting portions 44.

When a force does not act on the elastic piece portion 41 as indicated by a dot-and-dash line P in FIG. 9, a dimension between those portion of the elastic piece portion 41 (that is, the first wall 40*a*) and the second wall 40*b* which are disposed above the lock projection 42 is larger than a thickness of the arm portion 52 to be located therebetween. Also, a dimension between the first projecting portion 43 and the second projecting portions 44 which are disposed below the lock projection 42 is smaller than the thickness of the arm portion 52 to be located therebetween.

In the fixing portion 9 of this construction, an internal space of the tubular portion 40 is relatively large, and when a distal end portion of the arm portion 52 slides over the lock projection 42, this distal end portion is held between (or gripped by) the first projecting portion 43 and the second projecting portions 44, so that the arm portion 52 (that is, the lock arm 5) is located in a predetermined position. This predetermined position means a position where the lock arm 5 is located when the ECU 3 is located in a predetermined position (that is, a proper mounting position) relative to the body 2. Namely, when the lock arm 5 is located in its predetermined position, the ECU 3 is located in its predetermined position relative to the body 2. In this embodiment, the first wall 40*a* is formed by the elastic piece portion 41 having elasticity, and therefore when this elastic piece portion 41 is elastically deformed toward the upstanding portion 46, the arm portion 52 is held between the elastic piece portion 41 and the second projecting portions 44 with no clearance formed therebetween. Therefore, the lock arm 5 is positively located in the predetermined position thereof.

Simultaneously when the lower wall 3*b* of the ECU 3 abuts against the mounting surface portion 2*a* of the body 2, the lock arm 5 and the lock receiving portion 4 are retainingly engaged with each other, that is, the lock projection 42 fits into the through hole 52*a*, thereby fixing the ECU 3 and the body 2 to each other.

Figure 2:
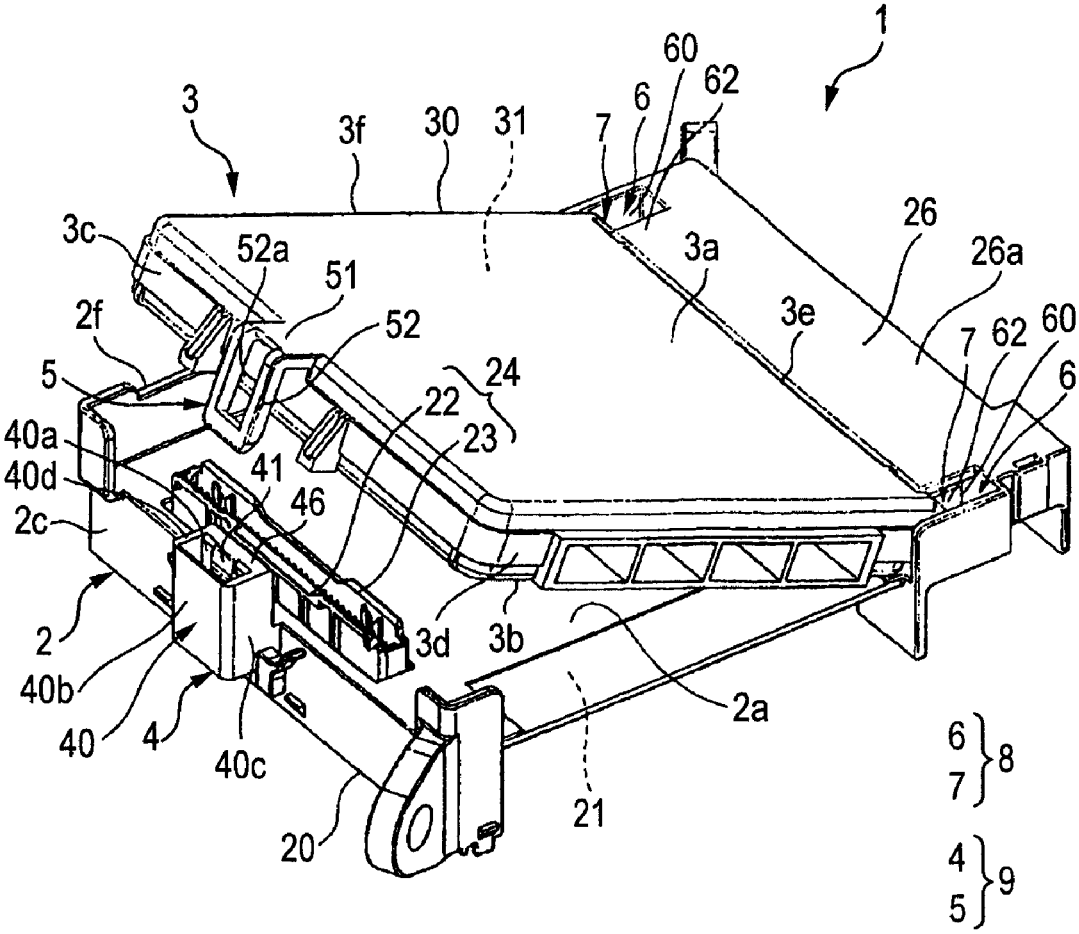
FIG. 2 is a perspective view of the electrical connection box of FIG. 1, showing the process of attaching the mounting member to the body.

In the electrical connection box 1 of the above construction, each shaft portion 72 is slid over (that is, moved in sliding contact with) the mounting surface portion 2*a* toward the inner end of the corresponding receiving recess 60, with the ECU 3 kept inclined relative to the mounting surface portion 2*a* as shown in FIGS. 2 and 5, and as a result the rotation portions 7 are located or received respectively in the receiving recesses 60.

The rotation portions 7 are inserted respectively into the receiving recesses 60 until the side wall 3*e* of the ECU 3 is brought into abutting engagement with the first limitation walls 61, and in this condition the ECU 3 is rotatably moved about the shaft portions 72 in such a manner that the other end (that is, the side wall 3*c*) of the ECU 3 is moved toward the mounting surface portion 2*a* as shown in FIG. 6. As a result, the lower wall 3*b* of the ECU 3 is superposed on the mounting surface portion 2*a*, and also the lock arm 5 is engaged with the lock receiving portion 4, thereby fixing the ECU 3 to the body 2 as shown in FIGS. 3 and 7. Namely, the ECU 3 is attached to the body 2.

At this time, the lock arm 5 is located in the predetermined position thereof by the first projecting portion 43 and the second projecting portions 44 at a final stage of the operation of engagement of the lock arm 5 with the lock receiving portion 4, and therefore the ECU 3 is located in its predetermined position (that is, its proper attaching position) relative to the body 2 at a final stage of the operation of attaching of the ECU 3 on the body 2. Therefore, a relative shaking movement between the ECU 3 and the body 2 in the direction of opposing of the side walls 3*e* and 3*c* to each other is prevented from developing.

In this condition, each shaft portion 72 is prevented by the first and second limitation walls 61 and 62 from being disengaged from the receiving recess 60. And besides, simultaneously when the ECU 3 is attached to the body 2, the connectors 24 and 34 are fitted together, so that the printed circuit boards 21 and 31 are electrically connected together.

In this embodiment, the projecting portions 43 and 44 are formed on and project from those portions of the inner surface of the tubular portion 40 disposed deeper than the lock projection 42 in the direction of inserting of the arm portion 52 into the tubular portion 40, and abut against the arm portion 52 to locate the lock arm 5 in the predetermined position thereof, thereby locating the ECU 3 in the predetermined position thereof relative to the body 2. Therefore, even when a clearance is formed between the tubular portion 40 and the arm portion 52, the development of a relative shaking movement between the ECU 3 and the body 2 after attaching the ECU 3 to the body 2 can be prevented merely by engaging the lock arm 5 with the lock receiving portion 4 without the need for fixing the ECU 3 and the body 3 together by screws or the like. Therefore, there can be provided the electrical connection box 1 in which the ECU 3 can be easily attached to the body 2 without being caught thereon, and also a relative shaking movement between the ECU 3 and the body 2 can be prevented from developing after the ECU 3 is attached to the body 2.

Furthermore, the first projecting portion 43 and the second projecting portions 44 are so disposed as to hold the arm portion 52 therebetween, and therefore the arm portion 52 can be located in a generally central region of the tubular portion 40 in the direction of opposing of the first projecting portion 43 and the second projecting portions 44 to each other, and therefore the arm portion 52 can be positioned (that is, located in the above predetermined position) with a smaller amount of movement of the arm portion 52 as compared with the case where the arm portion 52 is positioned by causing a projecting portion to abut against only one side (or surface) of the arm portion 52 such that the arm portion 52 abuts against that portion of the inner surface of the tubular portion 40 opposed to this projecting portion. Therefore, the ECU 3 can be more smoothly attached to the body 2.

Furthermore, the two second projecting portions 44 are formed on and along the inner surface of the second wall 40*b*, and are spaced from each other in the direction perpendicular to the direction of superposing of the ECU 3 on the body 2. Therefore, the area of contact of these second projecting portions 44 with the arm portion 52 can be reduced, and a frictional resistance can be reduced, and therefore the arm portion 52 can be located in the predetermined position within the tubular portion 40 with a smaller force. And besides, a lightweight design of the electrical connection box 1 can be achieved.

Furthermore, the electrical connection box includes the hinges 8, and the fixing portion 9 as described above, and therefore the shaft portions 72 are located respectively in the receiving recesses 60, and then the ECU 3 is pivotally moved toward the body 2 about these shaft portions 72, and merely by doing so, the ECU 3 can be easily attached to the body 2. Namely, it is not necessary to precisely position the ECU 3, and also it is not necessary to fix the ECU 3 to the body 2 by separate parts such as screws, and therefore the ECU 3 can be quite easily attached to the base 2.

In the electrical connection box 1, the ECU 3, while pivotally moved about the hinges 8, is attached to the body 2, and with this construction a larger clearance must be formed between the housing 30 and the housing 20, and also a larger clearance must be formed between the tubular portion 40 and the arm portion 52 as compared with the case where the ECU 3 is moved linearly toward the body 2, and is attached thereto. In the invention, however, there are provided the first and second projecting portions 43 and 44 for locating the lock arm 5 in the predetermined position thereof (that is, for locating the ECU 3 in the predetermined position thereof), and therefore even when such large clearances are provided, a relative shaking movement can be prevented from developing between the ECU 3 and the body 2.

Furthermore, in the electrical connection box 1, a relative shaking movement between the ECU 3 and the body 2 can be prevented as described above, and therefore wear of the terminals 22 and 32 of the connectors 24 and 34 can be prevented, and also the reliability of connection between the terminals 22 and the terminals 32 and hence the reliability of connection between the printed circuit boards 21 and 31 can be secured.

In the above embodiment, although the ECU 3 is used as the mounting member, the mounting member is not limited to such ECU, and any other mounting member such as a case, a part, etc., can be used in so far as it can be attached to the body 2. In the invention, each of the body and the mounting member does not always need to have the printed circuit board and the connector.

In the above embodiment, the through hole 52*a* serving as the projection receiving portion is formed in the arm portion 52, and the lock projection 42 is formed on the tubular portion 40. However, in the invention, the lock projection may be formed on the arm portion 52, while the projection receiving portion may be provided at the tubular portion 40. Furthermore, the projection receiving portion does not always need to be the through hole, and may be a depressed portion or recess. Furthermore, the lock receiving portion may be provided at the ECU 3, while the lock arm may be formed on the body 2.

In the above embodiment, although the two second projecting portions 44 are disposed on the common plane, and are arranged in spaced relation to each other in the direction perpendicular to the direction of superposing of the ECU 3 on the body 2. However, in the invention, the plurality of projecting portions may be arranged in any other suitable direction in so far as these projecting portions are formed at those portions of the inner surface of the tubular portion 40 disposed deeper than the lock projection 42 in the direction of inserting of the arm portion 52 into the tubular portion 40. Furthermore, when at least one projecting portion is provided on the inside of the tubular portion 40, this is acceptable.

The above embodiment is directed to the electrical connection box 1 in which the ECU 3 and the body 2 are pivotally connected together through the hinges 8. However, in the invention, the ECU 3 and the body 2 do not always need to be connected together through the hinges 8, and for example, the electrical connection box may be of the type in which the fixing portion 9 is provided at one ends of the ECU 3 and the body 2, and also another fixing portion 9 is provided at the other ends of the ECU and the body.

The above embodiment merely shows a representative form of the present invention, and the present invention is not limited to the above embodiment. Namely, the invention can be modified in various ways without departing from the subject matter of the invention.

What is claimed is:

1. An electrical connection box, comprising:

a body;

a mounting member attached to the body;

a lock arm which is provided at one of the body and the mounting member, the lock arm including:

an arm portion; and a first engaging portion provided at the arm portion;

a lock receiving portion which is provided at the other of the body and the mounting member, the lock receiving portion including:

a receiving portion which has an inserting port to receive the arm portion as the arm portion first enters the receiving portion; and a second engaging portion provided at a surface of the receiving portion so as to be engaged with the first engaging portion, wherein the arm portion extends generally in an inserting direction in which the arm portion enters into the receiving portion;

wherein the receiving portion includes a projection which projects from the surface of the receiving portion farther than the second engaging portion from the inserting port so as to abut on the arm portion to locate the lock arm in a predetermined position.

2. The electrical connection box according to claim 1, wherein one of the first engaging portion and the second engaging portion has a through hole; and wherein the other of the first engaging portion and the second engaging portion has a convex shape.

3. The electrical connection box according to claim 1, wherein one of the first engaging portion and the second engaging portion has a concave shape; and wherein the other of the first engaging portion and the second engaging portion has a convex shape.

4. The electrical connection box according to claim 1, wherein a plurality of the projections are provided so as to hold the arm portion therebetween.

5. The electrical connection box according to claim 1, wherein a plurality of the projections are provided in such a manner that the projections are spaced to each other along the surface of the receiving portion.

6. The electrical connection box according to claim 1, a clearance is formed between an outer wall providing the lock arm and an outer wall providing the lock receiving portion.

7. The electrical connection box according to claim 1, wherein the body and the mounting member are rotatably connected together at their one ends through a hinge; and wherein the lock arm and the lock receiving portion are provided at the other ends of the body and the mounting member.

8. The electrical connection box according to claim 1, wherein the body includes a first board having a first connector;

wherein the mounting member includes a second board having a second connector; and wherein when the mounting member is attached to the body, the first connector is fitted to the second connector so that the first board is electrically connected to the second board.

9. The electrical connection box according to claim 1, wherein the receiving portion has a tubular shape.

* * * * *